United States Patent [19]

Noakes et al.

[11] Patent Number: 4,765,539

[45] Date of Patent: Aug. 23, 1988

[54] ELECTROSTATIC SPRAYING APPARATUS

[75] Inventors: Timothy J. Noakes, Hampshire; Nevil E. Hewitt, Surrey; Arend L. Grocott; Philip C. W. Franks, both of Hampshire, all of England

[73] Assignee: Imperial Chemical Industries PLC, London, England

[21] Appl. No.: 830,875

[22] Filed: Feb. 19, 1986

[30] Foreign Application Priority Data

Feb. 19, 1985 [GB] United Kingdom ..... 8504253

[51] Int. Cl.[4] ..... B05B 5/02

[52] U.S. Cl. ..... 239/3; 239/706

[58] Field of Search ..... 239/690, 704, 705, 707, 239/3, 300, 706

[56] References Cited

U.S. PATENT DOCUMENTS 3,251,551 5/1966 Walberg ..... 239/705 X
3,761,941 9/1973 Robertson ..... 239/3 X
3,905,550 9/1975 Rokadia et al. ..... 239/690 X
4,082,070 4/1978 Saufferer et al. ..... 239/704 X
4,476,515 10/1984 Coffee ..... 239/690 X

*Primary Examiner*—Andres Kashnikow
*Assistant Examiner*—Kevin Patrick Weldon
*Attorney, Agent, or Firm*—Cushman, Darby & Cushman

[57] ABSTRACT

An apparatus and process for spraying liquids wherein liquid emerging from a sprayhead is subjected to an electrical field sufficiently high for the liquid to be drawn from the sprayhead in the form of one or more filaments. The filament or filaments become unstable and subsequently break up into droplets. A stream of gas is caused to flow through the region of the high electrical field, the gas flowing in a direction parallel or substantially parallel with the direction in which the liquid emerges from the sprayhead. Droplets are thus removed from the region and a built-in in space charge is reduced.

25 Claims, 7 Drawing Sheets

ELECTROSTATIC SPRAYING APPARATUS

This invention relates to the electrostatic spraying of liquids.

It has been proposed in our British Pat. No. 1,569,707 to spray liquid pesticides from a sprayhead charged to a high voltage under the influence of which the liquid is atomised into a cloud of charged droplets. Such processes have many advantages and are satisfactory under a wide range of operating conditions but there is a limit on the liquid flow-rate when small droplets are required.

A major factor contributing to this limit is the space charge associated with the cloud of charged droplets formed between the sprayhead and the target. This space charge reduces the electric field in the vicinity of the sprayhead and hence adversely affects the conditions for spray formation.

The effect of the space charge could be reduced by increasing the potential difference between the sprayhead and the target. However, higher voltages increase the risk to the operator and of spark ignition. They can also give rise to substantial corona discharge and require more expensive generators, which might no longer be portable.

A reduction in the effect of the space charge could also be obtained by reducing the distance between the sprayhead and the target. However, in many applications, such as agriculture, this distance is determined by other considerations, and hence it is not practical to reduce the sprayhead to target distance.

It is an object of the present invention to reduce the space charge between the sprayhead and the target, especially in the vicinity of the sprayhead, and thus to permit smaller droplets to be formed at a given liquid flow-rate or permit higher liquid flow-rates.

According to the present invention there is provided an electrostatic spraying apparatus comprising an electrostatic sprayhead, means for supplying a liquid to the sprayhead, means for subjecting liquid emerging from the sprayhead to an electrical field sufficiently high for the liquid to be drawn from the sprayhead in the form of at least one filament which subsequently becomes unstable and breaks up into droplets, and means for causing a stream of gas to flow through the region of the high electrical field, the stream of gas being insufficient to disrupt the formation of filaments but sufficient to remove charged droplets of liquid from the said region, thereby to reduce a build-up in space charge which affects the magnitude of the electrical field.

Preferably, there is an angle not greater than 30° between the direction in which the liquid emerges from the sprayhead and the direction in which the gas flows.

Preferably, the means for causing a stream of gas to flow through the region of the high electrical field are such that the velocity of the gas stream is equal to or greater than the velocity of the droplets in the absence of the stream of gas.

Suitably, at least a part of the stream of gas flows within 1.5 cms. of the or each location at which liquid emerges from the sprayhead, and preferably the stream of gas flows within 5 mms. of the or each location. Preferably, the stream of gas contacts the sprayhead at or near the location from which liquid emerges.

Since each region through which the stream of gas flows is relatively large, and since the gas is not required to shear the liquid, the gas need only be supplied at a low pressure ie. at a pressure not greater than 0.25 p.s.i. A high pressure source, such as a compressor, can be used as long as a pressure reducer is arranged between the source and the region of the high electrical field.

The means for subjecting liquid emerging from the sprayhead to an electrical field may comprise means for causing a first potential to be applied to liquid emerging from the sprayhead, and means for applying a second potential to a target towards which the emerging liquid is directed, the difference between the first and second potentials being sufficient to cause formation of the said filament or filaments.

An electrode may be mounted adjacent to the sprayhead, and the means for subjecting liquid emerging from the sprayhead to an electrical field comprise means for maintaining the electrode at an electrical potential, and means providing a return path for the flow of electrical charge between the sprayhead and the target.

Preferably, an electrode is mounted adjacent the sprayhead, and the means for subjecting liquid emerging from the sprayhead to an electrical field comprise means for causing a first potential to be applied to liquid emerging from the sprayhead, and means for maintaining the electrode at a second potential, the difference between the first and second potentials being sufficient to cause formation of the said filament or filaments.

In apparatus having a sprayhead comprising one or more small holes or points or an annular orifice from which the liquid emerges, the electrode may be disposed radially outwardly of the said one or more holes or points or orifice, and the stream of gas may be caused to flow through the region between the electrode and the one or more small holes or points or orifice. Alternatively, if the sprayhead comprises one or more holes or points or an annular orifice from which the liquid emerges, the electrode may be disposed radially inwardly of the said one or more holes or points or orifice, and the stream of gas may again be caused to flow through the region between the electrodes and the said one or more holes or points or orifice and/or through a region of similar material dimensions which is disposed radially outwardly of the said one or more holes or points or orifice.

In apparatus having a sprayhead comprising a linearly extending slot or edge from which liquid emerges and a pair of mutually spaced, linearly extending electrodes which extend parallel with the slot or edge on respective opposite sides thereof, the stream of gas is caused to flow through the regions between the slot or edge and each of the electrodes. If the sprayhead comprises a single linearly extending electrode which extends parallel with the slot or edge, the stream of gas is caused to flow through the region between the electrode and the slot or edge and may also flow through a region of similar dimensions or the side of the slot or edge remote from the electrode.

If the apparatus has no electrode, the stream of gas is caused to flow through a region or regions of similar dimensions to the region or regions through which gas flows in apparatus having such an electrode.

With a target at earth potential, the first potential applied to the liquid may be 1 to 2O KV and the second potential may be at or near earth potential, as disclosed in our UK specification No. 1.569.707.

Alternatively, the target may be at earth potential, the first potential at 25 to 50 KV, and the second potential at 10 to 4O KV, as disclosed in our co-pending UK application No. 8432274.

Alternatively, the target and the first potential may both be at earth potential and the second potential above 5 KV. In this case, the stream of gas sweeps the charged droplets away from the electrode and towards the target.

Preferably, the or each electrode comprises a core of conducting or semi-conducting material sheathed in a material of dielectric strength and volume resistivity sufficiently high to prevent sparking between the electrode and the sprayhead and of volume resistivity sufficiently low to allow charge collected on the surface of the sheathing material to be conducted through that material to the conducting or semi-conducting core. Suitably, the volume resistivity of the sheathing material is between $5\times10''$ and $5\times10^{13}$ ohm cms., the dielectric strength of the sheathing material is greater than 15 KV/mm and its thickness 0.75 to 5 mms., preferably 1.5 to 3 mms. Sheathed electrodes of this form are also disclosed in our co-pending UK application No. 8432274.

If the sprayhead comprises one or more holes or points from which the liquid emerges, a single filament is formed at each hole or point. Alternatively, the sprayhead may comprise at least one slot or edge, in which case a plurality of mutually spaced filaments is formed at the or each slot or edge.

An outlet of the sprayhead may comprise conducting or semiconducting material which is contacted by the emerging liquid, in which case the means for subjecting liquid emerging from the sprayhead to an electrical field may comprise means for causing an electrical potential to be applied to the said conducting or semi-conducting material. Alternatively, the outlet of the sprayhead may be made of non-conducting material and an electrode may be arranged a short distance upstream of the outlet from the sprayhead such that the electrode is contacted, in use, by the liquid, and the means for subjecting liquid emerging from the sprayhead to an electrical field comprise means for causing an electrical potential to be applied to the said electrode.

According to the invention there is also provided a process for spraying liquids comprising supplying a liquid to an electrostatic sprayhead, subjecting liquid emerging from the sprayhead to an electrical field sufficiently high for the liquid to be drawn from the sprayhead in the form of at least one filament which subsequently becomes unstable and breaks up into droplets, and causing a stream of gas to flow through the region of the high electrical field, the stream of gas flowing in a direction parallel with or substantially parallel with the direction in which liquid emerges from the sprayhead and the velocity of the stream being such that charged droplets are removed from the said region, thereby to reduce a build-up in space charge which affects the magnitude of the electrical field.

Entraining the charged droplets in a gas stream which is moving in the direction of the target increases the velocity of the droplets away from the sprayhead and towards the target, and hence increases the ratio of the droplet production rate to the number of droplets in the air between the sprayhead and target, especially in the vicinity of the sprayhead. This gives a corresponding reduction in space charge for a constant droplet production rate, or allows a higher droplet production rate to be obtained.

Using a gas stream to reduce the effect of the space charge, and hence improve the atomisation, also has the advantage of improving the penetration of spray into electrostatically screened areas of the target.

Our U.S. Pat. No. 4,356,528 mentions the use of an air-blast to improve penetration of charged droplets into crops. Such an air-blast will first carry the charged spray through existing gaps in the crop which otherwise would have been electrostatically screened. Secondly, at high air velocities, the air-blast will part the crop and make further openings for the spray to penetrate the crop. However, in U.S. Pat. No. 4,356,528 the air-blast entrains the droplets some distance away from the sprayhead, after they have moved out of the atomising electrical field between the sprayhead and the field intensifying electrode. Since the atomising electrical field is created by the potential difference between the sprayhead and the earthed field intensifying electrode, and since this type of air-assistance gives no reduction in space charge in the vicinity of the sprayhead and the field intensifying electrode, no improvement in atomisation is expected and no such effect has been observed.

Electrostatic spray guns which use air to atomise a liquid and high voltages to charge the liquid are known. An electrostatic spray gun which uses a combination of electric forces and air shearing forces to atomise the liquid has also been proposed. In this gun, however, filaments are never allowed to form at the outlet from the sprayhead, the air shearing drops from the electrostatically formed cusps.

Air-assistance can also be used to control the shape of the spray cloud.

Further, one problem with electrostatic spray guns is that dirt and liquid land on the sprayhead or nearby electrodes and upset the atomisation process. When air or some other gas is swept over the sprayhead and nearby electrodes, as in apparatus according to the present invention, an accumulation of dirt and liquid is prevented.

By reducing the space charge, gas or air-assistance also allows a wider range of liquids to be sprayed. The charge-to-mass ratio of the droplets produced by electrostatic atomisation depends on the droplet size and the physical parameters of the liquid. In particular, the charge-to-mass ratio is higher for smaller droplets and higher for lower resistivity liquids. In a normal electrostatic sprayer, such as those described in our UK Pat. No. 1.569.707, liquids with a resistivity below $5\times10^7$ ohm cms produce such highly charged droplets that the space charge limits the flow-rate at which they can be atomised to well below that for liquids with a resistivity between $10^8$ to $10^{10}$ ohm cms. The use of a gas stream to substantially reduce the space charge, enables liquids of a resistivity down to $5\times10^6$ ohm cms to be sprayed at acceptable flow-rates.

The invention will now be described, by way of example, with reference to the accompanying drawings, in which:

FIGS. 1*a*, 1*b*, 2, 3 and 3*a* are axial sections of electrostatic spraying apparatus according to the invention;

Figure 1:
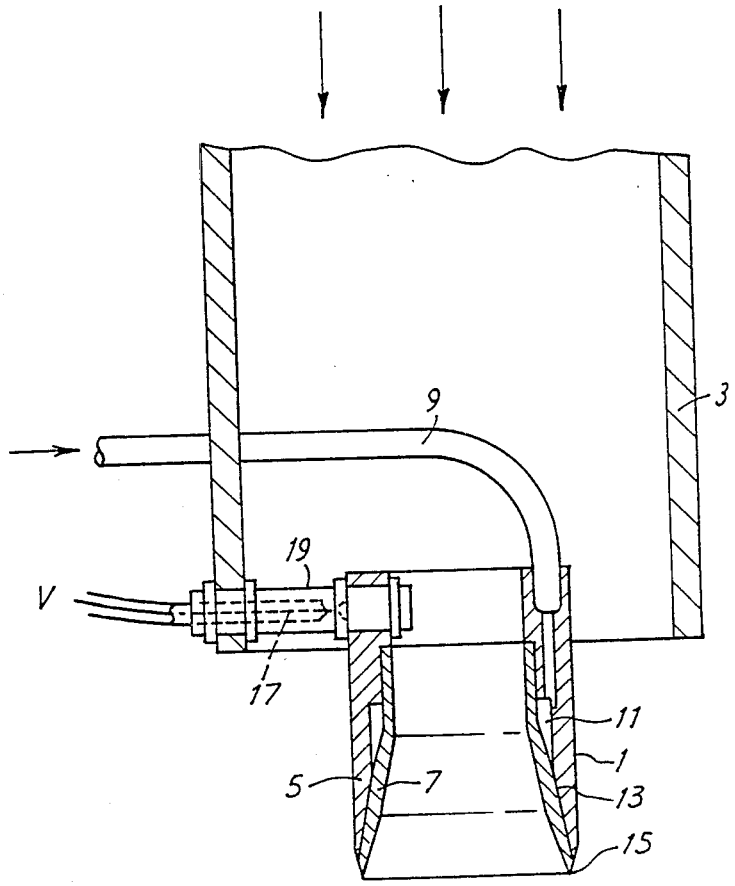

The apparatus of FIG. 1 is a simple annular electrostatic sprayhead 1 mounted at a lower end of a supporting tube 3 by means of a support 19. The sprayhead 1 includes two generally tubular elements 5 and 7 made of a conducting or semi-conducting material such as aluminium. A tube 9 for the supply of liquid to the sprayhead is connected to a distribution gallery 11, which is in turn connected to an annular gap 13 between the elements 5 and 7. The element 7 extends downwardly below the element 5 to provide an outlet in the form of an atomising edge 15.

The elements of the sprayhead 1 is connected to a high voltage generator (not shown) by a cable 17. The tube 3 and the support 19 are made of an insulating material.

An outlet of a pump (not shown) is connected to an upper end of the tube 3.

In use, the sprayhead 1 is arranged a short distance above a horizonal target, which is maintained at earth potential. Liquid is supplied to the sprayhead via the tube 9 and a high electrical potential is applied to the element 5. Finally air at a pressure below 0.4 p.s.i., preferably not greater than 0.25 p.s.i., is pumped down the tube 3 so that a moving air-stream flows over sprayhead 1, contacting the sprayhead at or near the location of the edge 15 ie. at or near the location at which liquid emerges from the sprayhead.

The rate of supply of liquid to the tube 9 is low. Accordingly, if there is no high potential on the element 5 the liquid merely drips from the edge 15. The effect of applying the potential to the element 5 is to establish an electrical field at the edge 15 which is sufficiently high for the liquid to be drawn from the edge in the form of a series of charged filaments or jets, each containing a continuous stream of liquid. The filaments are equi-angularly spaced about the axis of the sprayhead. When liquid in a filament has moved a short distance away from the edge 15 the filament becomes unstable and breaks up into charged droplets.

The air stream flows through a region adjacent the outlet edge 15 of the sprayhead 1, where there is a high electrical field. The direction of the air flow is downwards, ie. parallel or substantially parallel with the direction in which liquid emerges from the sprayhead, and the volume and velocity of the air are sufficient to carry the charged droplets away from the region of the high electrical field and to reduce the build-up in space charge.

Figure 2:
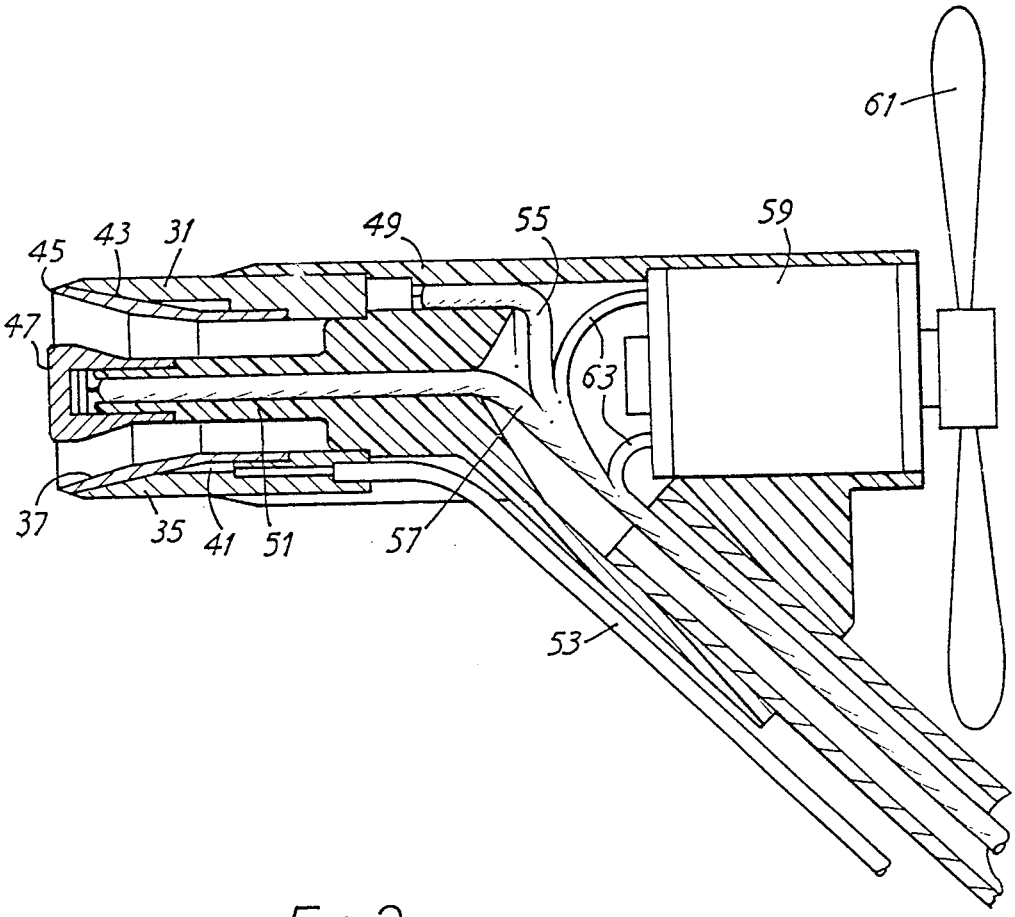

FIG. 2 shows a second apparatus according to the invention which includes a sprayhead 31 having tubular elements 35 and 37, a distribution gallery 41, a slot 43 and an atomising edge 45 which forms an outlet orifice of the sprayhead, as in the apparatus of FIG. 1. A field intensifying electrode 47 is disposed coaxially of the sprayhead 31, radially inwardly of and adjacent the atomising edge 45.

The sprayhead 31 is mounted at one end of a generally tubular insulating body 49 having a central support 51 on which the field intensifying electrode 47 is mounted.

A tube 53 is connected to the distribution gallery 41, a cable 55 from a high voltage generator (not shown) is connected to the element 35 of the sprayhead and a cable 57 from a tapping on the generator is connected to the electrode 47.

The end of the body 49 serves as a housing for an electric motor, which has a propeller 61 mounted on a shaft thereof. Electric power is supplied to the motor 59 via a cable 63 from a low-voltage supply (not shown).

In use, a first potential is applied to sprayhead 1 via cable 55, a second potential of smaller magnitude is applied to the field intensifying electrode 47 via the cable 35, and liquid is supplied to the sprayhead 31 through the tube 53.

The rate of supply of liquid is low and, in the absence of a potential on the electrode 47, the forces of surface tension are sufficient to cause the liquid to emerge from the edge 45 in the form of drops rather than a filament or jet. The effect of the potential on the electrode 47 and the resultant electric field at the edge 45 is to cause liquid to be drawn out from the edge in the form of a series of narrow, mutually spaced filaments or jets. After moving a short distance away from the edge 45, the filaments become unstable and break up into charged droplets. When the motor 59 is energised, a stream of air flows in an axial direction, along the outside of the body 49 and through the region between the electrode 47 and the edge 45, where there is a high electrical field. This air stream carries the charged droplets of liquid towards the target.

Figure 3:
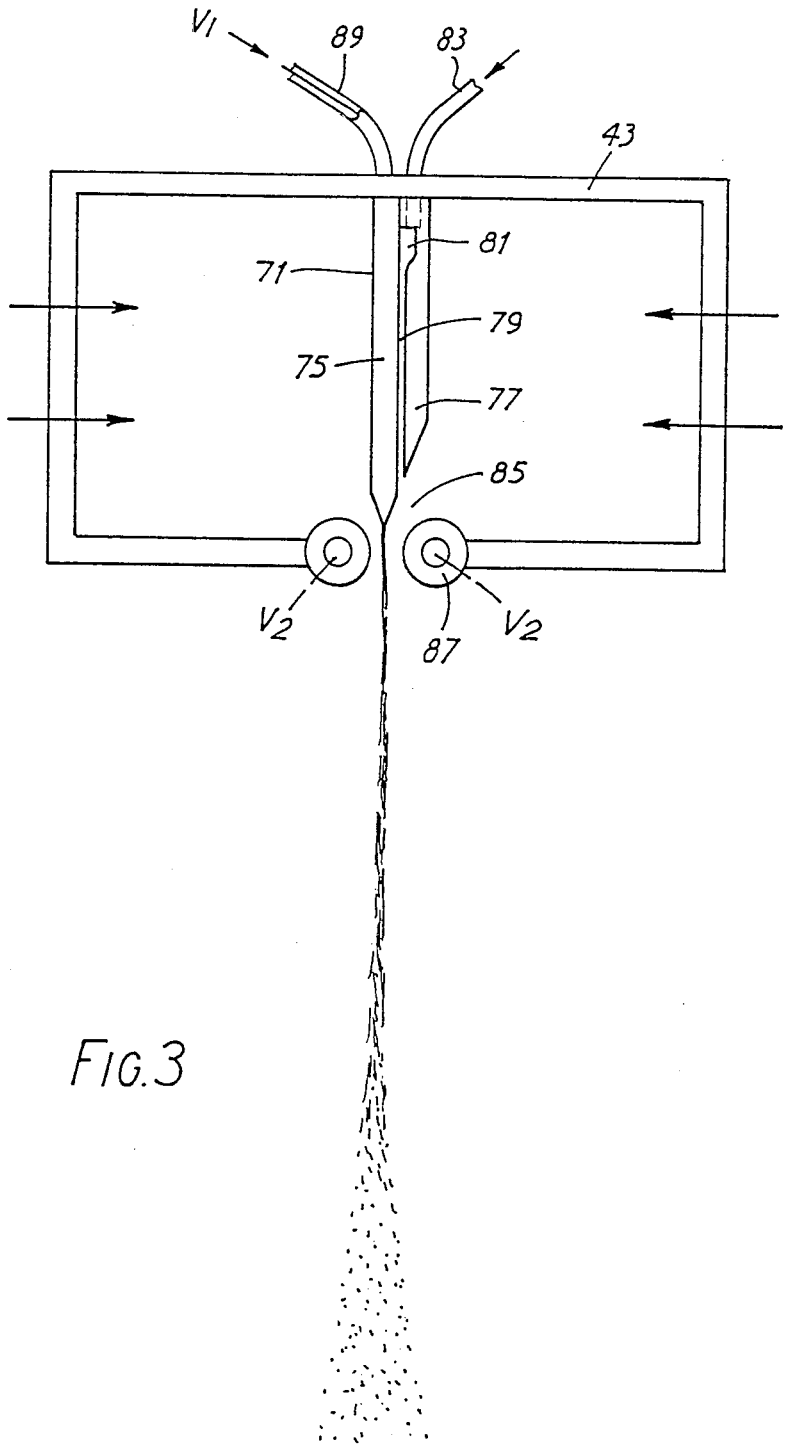

FIG. 3 shows a cross-section of a linear sprayhead 71 mounted inside an insulating air-box 73.

The sprayhead 71 includes two mutually spaced, parallel arranged plates 75 and 77 of conducting or semiconducting material, between which is a channel 79 for liquid. At an upper end of the channel 79 there is a distribution gallery 81 which is connected via a tube 83 to a tank (not shown). The plate 75 extends downwardly below the plate 77 to provide a linearly extending atomising edge 85.

Associated with the sprayhead 71 are two mutually spaced, linear field intensifying electrodes 87 which extend parallel with and on respective opposite sides of the edge 85. The electrodes are spaced a short distance away from the edge 85.

Each of the electrodes 87 has a core of conducting or semiconducting material and a sheath of a material having a dielectric strength and volume resistivity sufficiently high to prevent sparking between the electrode and the sprayhead and a volume resistivity sufficiently low to allow charge collected on the surface of the sheathing material to be conducted through that material to the core.

The plate 75 of the nozzle is connected via a cable 89 to a high voltage generator (not shown) and the electrodes 87 are connected to the generator via further cables (also not shown).

In use, liquid is supplied to the sprayhead 71 via the tube 83 and flows downwardly via the gallery 81 and the channel 79 to the atomising edge 85. A voltage $V_1$ is applied to the plate 75 via the cable 89, a voltage $V_2$, less than $V_1$, is applied to the electrodes 87, and a target (not shown) which is disposed below the sprayhead 71 and electrodes 87 is maintained at earth potential. Liquid emerging from the atomising edge 85 of the sprayhead 71 forms a series of filaments which are mutually spaced in a direction lengthwise of the edge 85. The liquid in each filament becomes unstable and breaks up into droplets a short time after leaving the edge 85.

When air is pumped into the air-box 73 it exits at high velocity through the regions between the edge 85 and each of the electrodes 87, where there is a high electrical field. Charged droplets in this region of high field intensity are swept downwardly away from the sprayhead 71 and towards the target.

Figure 1A:
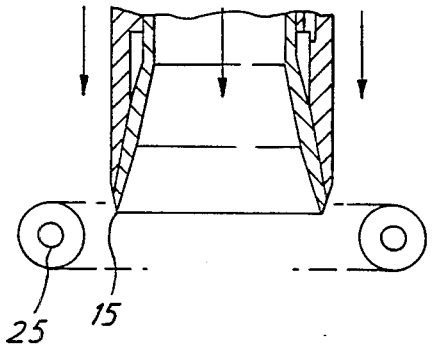
Figure 1B:
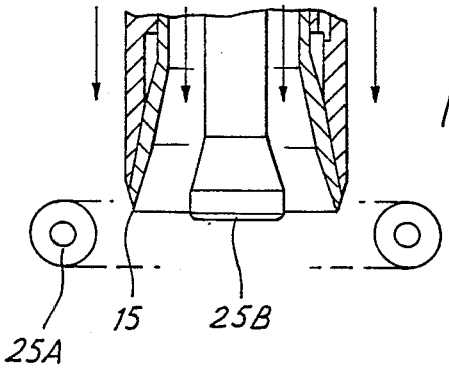
Figure 3A:
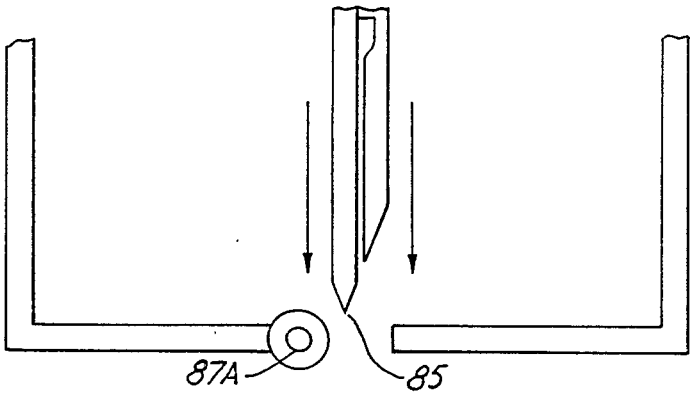

It will be appreciated that a field intensifying electrode may be included in the apparatus of FIG. 1. This electrode may be disposed radially inwardly of the atomising edge 15 (as in the case of electrode 47 in FIG. 2). Alternatively, as shown in FIG. 1A, an electrode 25 may be disposed radially outwardly of the edge 15. In some cases, as shown in FIG. 1B there may be two electrodes, an electrode 25B disposed radially inwardly of the atomising edge 15 and another electrode 25A disposed radially outwardly of the atomising edge 15.

Likewise, an apparatus having a linearly extending atomising edge, as shown in FIG. 3, may have only a single, linear field intensifying electrode or there may be no field intensifying electrode, as in the sprayhead shown in FIG. 1.

In each of the apparatus described above, liquid emerging from a sprayhead is subjected to an electrical field which is established by applying a first electrical potential to a conducting or semiconducting part of the sprayhead or to an electrode in a sprayhead of non-conducting material and maintaining a target at some other potential, usually earth potential. In some cases there is a field intensifying electrode which is also maintained at a predetermined potential.

If there is no air flow past the sprayhead, the potential applied to the field intensifying electrode is suitably −20 KV and the potential applied to the sprayhead is suitably −30 KV. Negatively charged droplets are attracted to the electrode but there is a much stronger and dominating attraction towards the earthed target. The charge from the few droplets which are deposited on the electrode flows through a high value (eg. 10GΩ) resistor oonnecting the output of a generator supplying the potential to the electrode to earth. If the potentials on the electrode and the sprayhead are reduced, whilst keeping the differential potential constant, the level of contamination of the electrode rises to an unacceptable degree. However, with an air flow past the sprayhead it is found that satisfactory operation can be obtained with −10 KV on the sprayhead and OKV on the electrode.

In further apparatus according to the invention, a field intensifying electrode is maintained at +1O KV and the sprayhead is merely connected to earth potential. Negative charges are induced in liquid emerging from the sprayhead and the liquid on the atomising edge of the sprayhead assumes an "image" charge roughly equivalent to the charge which would be produced by applying a potential of about −10 KV to the atomising edge. The negatively charged droplets are strongly attracted to the positive electrode, and would normally all be deposited thereon, but because the droplets are entrained in a high velocity stream of gas they are swept away from the vicinity of the electrode. By the time the gas stream has slowed sufficiently to allow some freedom of movement they are far enough away to be preferentially attracted to the earthed target.

It will be appreciated that the field intensifying electrode can be maintained at −10 KV, which gives rise to positively charged droplets.

In the apparatus described above, air flows parallel or substantially parallel with the direction in which liquid emerges from each sprayhead. In fact there can be an angle not greater than 30° between the direction of the air flow and the direction in which the liquid emerges from the sprayhead.

In the apparatus according to the invention which has been described above, the moving air-stream does not disrupt the filament formation or the subsequent break-up of the filaments into droplets. It is an important feature of the break-up of a filament that the diameter of the primary droplets so produced are constant and are directly related to the diameter of the filament. (See Adrian G Bailey, Sci. Prog., Oxf (1974) 61, 555–581). In addition, satellite droplets are sometimes produced which have diameters much smaller than the primary droplets. In theory, electrostatic sprayers according to the invention produce filaments of equal diameters which are equally spaced along the atomising surface of the sprayhead, and hence a mono-disperse disperse spectrum of primary droplet size should be produced. In practice, limitations on mechanical tolerances give slight variations in the electric field and liquid flow-rate at different points of the sprayhead and the primary droplets produced form a narrow spectrum of diameters.

Figure 4:
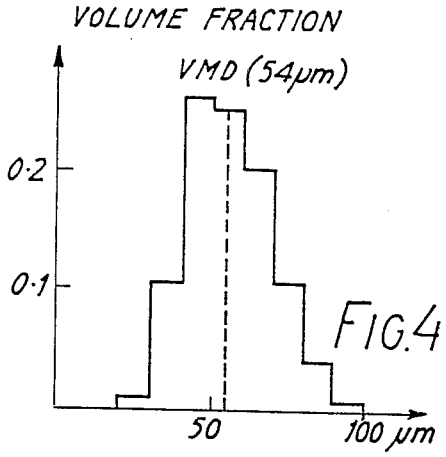
FIGS. 4 and 5 are graphs showing the volume mean distribution of droplet diameters (VMD) and the number median distribution of droplet diameters (NMD), respectively, for the spraying apparatus of FIG. 3.
Figure 5:
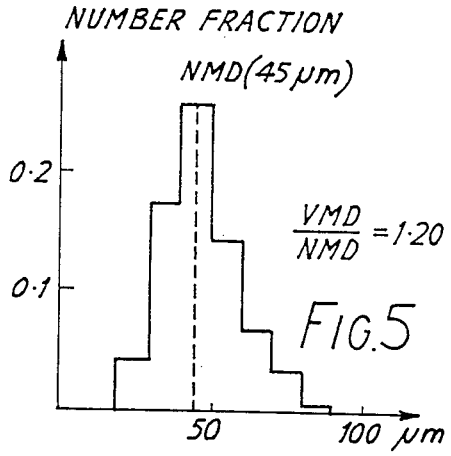
Figure 6:
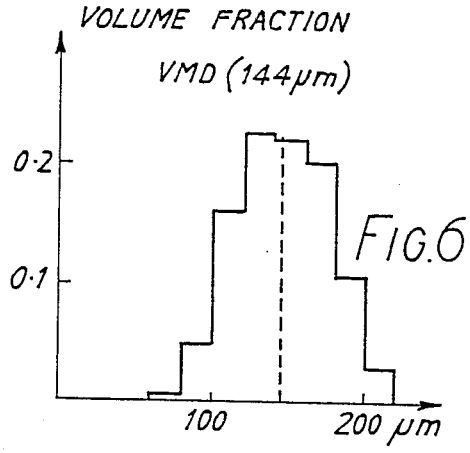
FIGS. 6 and 7 are graphs showing the VMD and the NMD, respectively, for previously proposed electrostatic spraying apparatus.
Figure 7:
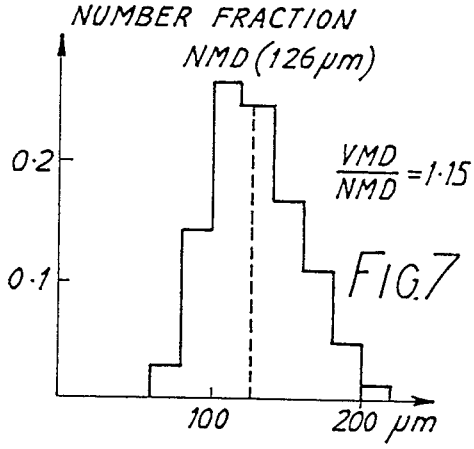
Figure 8:
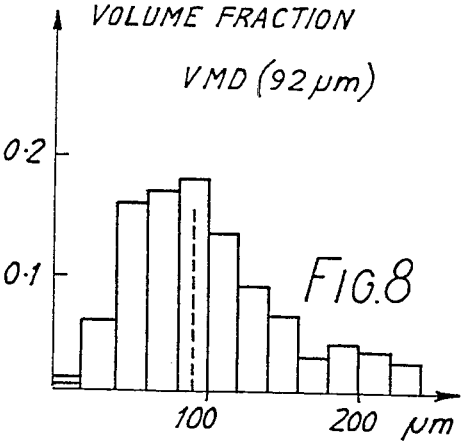
FIGS. 8 and 9 are graphs showing the VMD and the NMD, respectively, for spraying apparatus which employs the shearing effect of an air-blast to cause atomisation.
Figure 9:
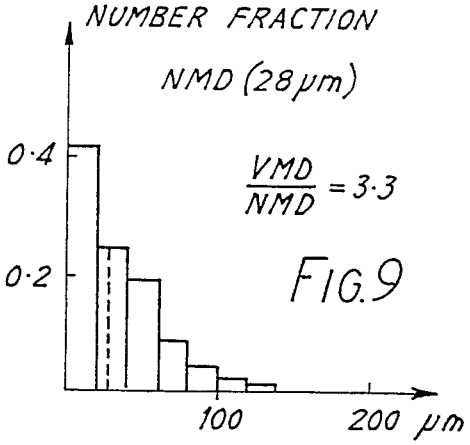
Figure 10:
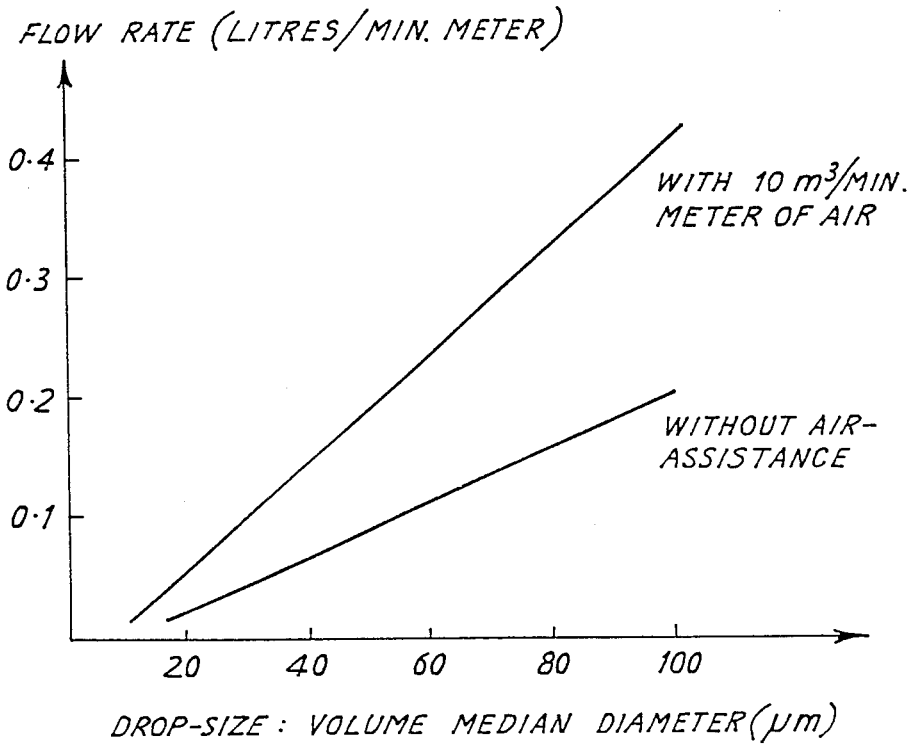
FIG. 10 is a graph showing the relationship between droplet size and flow-rate for the apparatus of FIG. 3.
Figure 11:
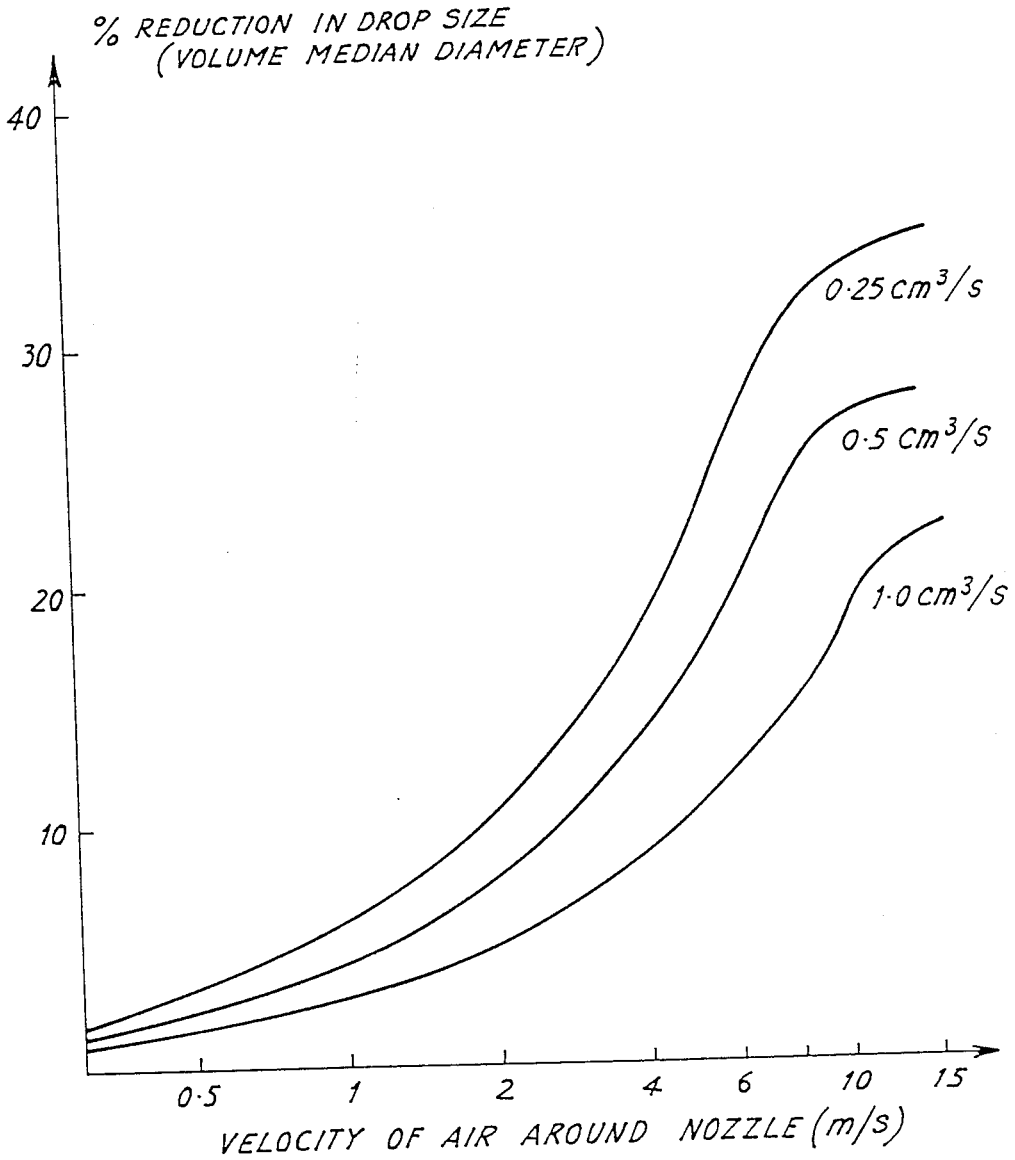
FIG. 11 is a graph showing the reduction in droplet size with the velocity of the air stream in the apparatus of FIG. 2.

FIG. 4 of the drawings shows a typical volume distribution of droplet diameters and FIG. 5 the corresponding number distribution of droplet diameters for a sprayer of the form shown in FIG. 3. The sprayer has a linear nozzle which is 50 cms long and is maintained at earth potential, a liquid flow-rate of 1.8 cc/sec. and field intensifying electrodes at −10 KV. FIGS. 6 and 7 are similar distributions for a similar sprayer which has no air-stream through the region of the high electrical field, the nozzle being maintained at −30 KV and the field intensifying electrodes at −20 KV. The fact that the distributions of FIGS. 4 and 5, with air-assistance, are similar to the distributions of FIGS. 6 and 7, without air-assistance, indicates that the moving air-stream does not disrupt the filament formation and subsequent break-up into droplets. In contrast, FIGS. 8 and 9 show a typical volume and number distribution for a sprayer using air-shear to atomise the liquid.

One measure of the dispersion of the droplet spectrum is the ratio of the volume median diameter to the number median diameter (VMD/NMD). For sprayers in which filaments are formed by electrical fields and the subsequent break-up into droplets is due to hydrodynamic forces, such as the sprayers of FIGS. 1 to 3, this ratio is often below 1.1, and generally below 1.5. For most air-shear sprayers, with or without electrostatics, this ratio is generally above 2 and often above 5.

To ensure that the moving air-stream does not disrupt the formation and break-up of the filaments, the sprayhead in apparatus according to the invention is preferably adapted to spray predominantly in the general direction of the target, and the air-stream is directed predominantly parallel to this direction. It is possible, however, for the sprayhead to be adapted to spray radially relative to the general direction from the sprayhead to the target and for the air-stream to be directed towards the target. This suffers from the disadvantages that it is difficult to avoid turbulence near the sprayhead, which upsets the atomisation process, and that the volume of air must be carefully controlled to achieve satisfactory performance.

In apparatus according to the invention, it is the velocity of the air-stream which effects improvements in atomisation. In order for the air-stream to give significant reductions in the space charge, the air-stream should give a significant increase in velocity to the droplets issuing from the sprayhead. If the velocity of the air-stream is an order of magnitude smaller than the velocity of the droplets, there will be only a small reduction in space-charge and negligible improvements in atomisation. If the velocity of the air stream is similar to the velocity of the droplets when no air-stream is applied, there will be a major reduction in space charge and significant improvements in atomisation. If the velocity of the air-stream is much larger than the velocity of the droplets when no air-stream is applied, the effect of space charge in suppressing atomisation will have mostly been removed, and optimal improvements in atomisation will result.

FIG. 7 shows the improved performance in terms of reduced droplet size for a given liquid flow-rate of a sprayer similar to that shown in FIG. 3 air being supplied at a rate 10 $m.^3$/minute, and a similar sprayer having no air-assistance. In each case the sprayer has a linear nozzle maintained at 40 KV and spaced 40 cms from a target. FIG. 8 shows the effect on drop size of increasing the velocity of the air-stream near to the sprayhead in apparatus of the form shown in FIG. 2, there being a potential of 40 KV on the nozzle, 20 KV on the field intensifying electrode and a spacing of 40 cms between the nozzle and the target.

In apparatus such as that shown in FIG. 1, where there are no field intensifying electrodes, the difference between the first potential on the sprayhead and the target potential, normally earth, is sufficiently large to create an atomising electric field at the outlet from the sprayhead, whereby the liquid is drawn out into filaments, which break-up into droplets, which move towards the target in the air-stream. Typically, the first potential is 50 KV or more, the precise value depending upon the spacing between the sprayhead and the target.

In apparatus such as that shown in FIGS. 2 and 3, field intensifying electrodes placed adjacent to the sprayhead, and means are provided for applying a second potential to these electrodes. In such apparatus the difference between the first potential applied to the sprayhead and the second potential applied to the electrodes is sufficiently large to create an atomising electric field at the outlet of the sprayhead, whereby the liquid is atomised and carried towards the target as described above. If the target is earthed, the first potential may be 30 KV and the second potential 20 KV. In this case the electrostatic forces cause the droplets to be accelerated through the moving air-stream towards the target. Alternatively, the first potential and the target may both be earthed, whilst the second potential is 10 KV. In this case, the droplets are carried by viscous drag forces against the electrostatic forces towards the target by the moving air-stream, until they are again attracted electrostatically to the target.

While the apparatus of FIGS. 1 to 3 has been shown as spraying downwardly, each apparatus can be made to spray in any direction.

What is claimed is:

1. An electrostatic spraying apparatus comprising an electrostatic sprayhead, means for supplying a liquid to the sprayhead, means for subjecting liquid emerging from the sprayhead to an electrical field sufficiently high for the liquid to be drawn from the sprayhead in the form of at least one filament which subsequently becomes unstable and breaks up into droplets, and means for causing a stream of gas to flow through the region of the high electrical field, there being an angle not greater than 30° betwen the direction in which the liquid emerges from the sprayhead and the direction in which the gas flows and the stream of gas being insufficient to disrupt the formation of filaments but sufficient to remove charged droplets of liquid from said region, thereby to reduce a build-up in space charge which affects the magnitude of the electrical field.

2. An electrostatic spraying apparatus as claimed im claim 1 wherein the means for causing a stream of gas to flow through the region of the high electrical field are such that the velocity of the gas stream is equal to or greater than the velocity of the droplets in the absence of the stream of gas.

3. An electrostatic spraying apparatus as claimed in claim 1 wherein at least a part of the stream of gas flows within 1.5 cms. of the or each location at which liquid emerges from the sprayhead.

4. An electrostatic spraying apparatus as claimed in claim 1, wherein the said at least part of the stream of gas flows within 5 mms. of the or each location at which liquid emerges from the sprayhead.

5. An electrostatic spraying apparatus as claimed in claim 1 wherein the stream of gas contacts the sprayhead at or near the location at which liquid emerges therefrom.

6. An electrostatic spraying apparatus as claimed in claim 1, wherein the said means for supplying gas are adapted to supply gas at a pressure not greater than 0.25 pounds per square inch.

7. An electrostatic spraying apparatus as claimed in claim 1, wherein an electrode is mounted adjacent to the sprayhead, and the means for subjecting liquid emerging from the sprayhead to an electrical field comprise means for causing a first potential to be applied to liquid emerging from the sprayhead, and means for maintaining the electrode at a second potential, the difference between the first and second potentials being sufficient to cause formation of the said at least one filament.

8. An electrostatic spraying apparatus as claimed in claim 7, wherein the sprayhead comprises one or more holes or points or an annular orifice from which the liquid emerges, the electrode is disposed radially outwardly of the said one or more holes or points or orifice, and the stream of gas is caused to flow through the region between the electrode and the said one or more holes or points or orifice.

9. An electrostatic spraying apparatus as claimed in claim 7, wherein the sprayhead comprises one or more holes or points or an annular orifice from which the liquid emerges, the electrode is disposed radially inwardly of the said one or more holes or points or orifice and the stream of gas is caused to flow through the region between the electrode and the said one or more holes or orifice.

10. An electrostatic spraying apparatus as claimed in claim 7, wherein the sprayhead comprises a linearly extending slot or edge from which the liquid emerges, and a pair of mutually spaced, linearly extending electrodes extend parallel with the slot or edge on respective opposite sides thereof, the stream of gas being caused to flow through the regions between the slot or edge and each of the electrodes.

11. An electrostatic spraying apparatus as claimed in claim 7, wherein the sprayhead comprises a linearly extending slot or edge from which the liquid emerges, and a linearly extending electrode which extends parallel with the slot or edge or at one side thereof, the stream of gas being caused to flow through the region between the electrode and the slot or edge.

12. An electrostatic spraying apparatus as claimed in claim 11, wherein the stream of gas is caused to flow through a region of same dimensions on the other side of the slot or edge remote from the electrode.

13. An electrostatic spraying apparatus as claimed in claim 7, wherein for spraying a target at earth potential, the first potential is 1 to 10 KV, and the second potential is at or near earth potential.

14. An electrostatic spraying apparatus as claim in claim 7, wherein for spraying a target at earth potential, the first potential is 25 to 50 KV, and the second potential is 10 to 40 KV.

15. An electrostatic spraying apparatus as claimed in claim 7, wherein for spraying a target at earth potential, the first potential is earth potential, and the second potential is above 5 KV.

16. An electrostatic spraying apparatus as claimed in claim 7, wherein the or each electrode comprises a core of conducting or semiconducting material sheathed in a material of dielectric strength and volume resistivity sufficiently high to prevent sparking between the electrode and the sprayhead and of volume resitivity sufficiently low to allow charge collected on the surface of the shething material to be conducted through that material to the conducting or semiconducting core.

17. An electrostatic spraying apparatus as claimed in claim 16, wherein the volume resistivity of the sheathing material is between $5\times10^{11}$ and $5\times10^{13}$ ohm. cms., the dielectric strength of the sheathing material is greater than 15 KV/mm., and the thickness of the sheathing material is 0.75 to 5 mms.

18. An electrostatic spraying apparatus as claimed in claim 17, wherein the thickness of the sheathing material is 1.5 to 3 mms.

19. An electrostatic spraying apparatus as claimed in claim 1, wherein the sprayhead comprises one or more holes or points from which liquid emerges, and a single filament is formed at each hole or point.

20. An electrostatic spraying apparatus as claimed in claim 1, wherein the sprayhead comprises at least one slot or edge, and a plurality of mutually spaced filaments is formed at the slot or edge.

21. An electrostatic spraying apparatus as claimed in claim 1, wherein an outlet of the sprayhead comprises conducting or semiconducting material which is contacted by the emerging liquid, and the means for subjecting liquid emerging from the sprayhead to an electrical field comprise means for causing an electrical potential to be applied to the conducting or semiconducting material.

22. An electrostatic spraying apparatus as claimed in claim 1, wherein an outlet of the sprayhead is made of non-conducting material, an electrode is arranged a short distance upstream of the outlet from the sprayhead and at a location such that the electrode is contacted, in use, by the liquid and the means for subjecting liquid emerging from the sprayhead to an electrical field comprise means for causing an electrical potential to be applied to the said electrode.

23. Apparatus as claimed in claim 1, wherein the stream of gas flows in a direction parallel with or substantially parallel with the direction in which liquid emerges from the sprayhead.

24. An electrostatic spraying apparatus as in claim 7 wherein the sprayhead comprises one or more holes or points or an annular orifice from which the liquid emerges, wherein the electrode is disposed radially inwardly of said one or more holes or points or orifice, wherein there is another electrode disposed radially outwardly of said one or more holes or points or orifice, and wherein the stream of gas is caused to flow through regions which are radially inward and radially outward of said one or more holes, points or orifice.

25. A process for spraying liquids comprising supplying a liquid to an electrostatic sprayhead, subjecting liquid emerging from the sprayhead to an electrical field sufficiently high for the liquid to be drawn from the sprayhead in the form of at least one filament which subsequently becomes unstable and breaks up into droplets, and causing a stream of gas to flow through the region of the high electrical field there being an angle not greater than 30° between the direction in which liquid emerges from the sprayhead and the direction in which the stream of gas flows and the stream of gas being insufficient to disrupt the formation of filaments but being sufficient to remove charged droplets from the said region, thereby to reduce a build-up in space charge which affects the magnitude of the electrical field.

* * * * *